US011094444B2

(12) United States Patent
Matsuura et al.

(10) Patent No.: US 11,094,444 B2
(45) Date of Patent: Aug. 17, 2021

(54) COIL COMPONENT

(71) Applicant: Murata Manufacturing Co., Ltd., Kyoto-fu (JP)

(72) Inventors: Kouhei Matsuura, Nagaokakyo (JP); Morihiro Hamano, Nagaokakyo (JP); Keiichi Tsuduki, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 313 days.

(21) Appl. No.: 15/991,913

(22) Filed: May 29, 2018

(65) Prior Publication Data

US 2018/0350500 A1 Dec. 6, 2018

(30) Foreign Application Priority Data

Jun. 5, 2017 (JP) ..... JP2017-110925

(51) Int. Cl.
*H01F 5/00* (2006.01)
*H01F 17/00* (2006.01)
(Continued)

(52) U.S. Cl.
CPC ..... *H01F 17/0013* (2013.01); *H01F 17/06* (2013.01); *H01F 27/292* (2013.01);
(Continued)

(58) Field of Classification Search
USPC ..... 336/200, 223, 232
See application file for complete search history.

(56) References Cited

U.S. PATENT DOCUMENTS

2008/0303621 A1* 12/2008 Ito ..... H01F 19/04 336/200
2009/0003191 A1* 1/2009 Inuzuka ..... H01F 17/0013 369/283
2011/0181384 A1* 7/2011 Inuduka ..... H01F 17/0013 336/234

FOREIGN PATENT DOCUMENTS

CN 1993780 A 7/2007
CN 102186792 A 9/2011
(Continued)

OTHER PUBLICATIONS

An Office Action; "Notification of Reasons for Refusal," Mailed by the Japanese Patent Office dated Sep. 3, 2019, which corresponds to Japanese Patent Application No. 2017-110925 and is related to U.S. Appl. No. 15/991,913; with English language translation.

*Primary Examiner* — Ronald Hinson
(74) *Attorney, Agent, or Firm* — Studebaker & Brackett PC

(57) ABSTRACT

A coil component including a multilayer body, at least one coil provided inside the multilayer body, and outer electrodes disposed on at least one surface of the multilayer body. The multilayer body includes a first magnetic layer, an insulating layer laminated on the first magnetic layer, and a second magnetic layer laminated on the insulating layer. The coil has, at both ends thereof, lead-out portions, each of which extends up to the surface of the multilayer body and is connected to a respective one of the outer electrodes. The outer electrodes are each present over surfaces of the first magnetic layer, the insulating layer, and the second magnetic layer, and a width of a portion of at least one of the outer electrodes contacting the insulating layer is larger than widths of each of portions of that outer electrode contacting the first and second magnetic layers.

19 Claims, 5 Drawing Sheets

(51) Int. Cl.

| | |
|---|---|
| ***H01F 17/06*** | (2006.01) |
| ***H01F 27/29*** | (2006.01) |
| *H01F 27/34* | (2006.01) |

(52) U.S. Cl.
CPC ..... *H01F 27/34* (2013.01); *H01F 2017/0066* (2013.01); *H01F 2017/0093* (2013.01)

(56) References Cited

FOREIGN PATENT DOCUMENTS

| | | | |
|---|---|---|---|
| JP | H06060131 | U | 8/1994 |
| JP | 2006-319009 | A | 11/2006 |
| JP | 2007-081228 | A | 3/2007 |
| JP | 2012-079870 | A | 4/2012 |
| JP | 2013-183009 | A | 9/2013 |
| JP | 2016-178140 | A | 10/2016 |

* cited by examiner

COIL COMPONENT

CROSS-REFERENCE TO RELATED APPLICATION

This application claims benefit of priority to Japanese Patent Application No. 2017-110925, filed Jun. 5, 2017, the entire content of which is incorporated herein by reference.

BACKGROUND

Technical Field

The present disclosure relates to a coil component such as a common mode choke coil.

Background Art

In the past, examples of a coil component have been disclosed in Japanese Unexamined Patent Application Publication No. 2007-81228 and No. 2016-178140.

Japanese Unexamined Patent Application Publication No. 2007-81228 discloses a surface-mounted electronic component array to be mounted to another component. The array includes a base body having a substantially rectangular parallelepiped shape, and at least four outer electrodes formed on surfaces of the base body. The base body has a first surface that constitutes a mounting surface of the other component, four second surfaces adjacent to the first surface, and a third surface opposing to the first surface and adjacent to each of the second surfaces. Each of the outer electrodes includes a first electrode portion formed on the first surface, and a second electrode portion formed in continuation with the first electrode portion and extending to a corner between the second and third surfaces, any of the outer electrodes being substantially not formed on the third surface.

Japanese Unexamined Patent Application Publication No. 2016-178140 discloses a common mode noise filter including a multilayer body constituted by a plurality of laminated insulator layers, three coil conductors disposed inside the multilayer body, and outer electrodes connected to the coil conductors disposed inside the multilayer body. The three coil conductors are disposed on one of the insulator layers, each of the three coil conductors being provided in a spiral shape of one or more turns, and being formed to have a substantially rectangular outer shape made up of a long side and a short side when viewed in a plane perpendicular to a winding axis of the one or more spiral turns. Two of the three coil conductors are arranged with the long sides of the two coil conductors facing each other, and the short sides of the two coil conductors are arranged to face the long side of the remaining coil conductor.

With increasing size reduction of electronic components such as coil components, the size of an outer electrode provided in the electronic component tends to reduce. With further size reduction of the outer electrode, however, adhesion force between the outer electrode and the multilayer body is more apt to weaken. This may result in a possibility that the outer electrode peels off from the multilayer body upon application of mechanical stress.

SUMMARY

Accordingly, the present disclosure provides a coil component in which adhesion force between an outer electrode and a multilayer body is increased, and in which high reliability is ensured.

According to a preferred embodiment of the present disclosure, there is provided a coil component including a multilayer body, at least one coil provided inside the multilayer body, and outer electrodes disposed on at least onesurface of the multilayer body. The multilayer body includes a first magnetic layer, an insulating layer laminated on the first magnetic layer, and a second magnetic layer laminated on the insulating layer. The coil has lead-out portions, each of which extends to the surface of the multilayer body and is connected to a respective one of the outer electrodes. The outer electrodes are each present over respective surfaces of the first magnetic layer, the insulating layer, and the second magnetic layer. A width of a portion of at least one of the outer electrodes contacting the insulating layer is larger than a width of each of portions of the one outer electrode contacting the first magnetic layer and the second magnetic layer.

With the above coil component according to the preferred embodiment of the present disclosure, the width of at least one of the outer electrodes at its portion contacting the insulating layer is larger than that of each of the portions of the one outer electrode contacting the first magnetic layer and the second magnetic layer. Therefore, adhesion force between the outer electrode and the multilayer body is increased, and peeling-off of the outer electrode can be prevented. Hence reliability of the coil component can be increased.

In the coil component according to another preferred embodiment of the present disclosure, the insulating layer contains glass and/or a composite material of glass and ferrite. With this embodiment, when the outer electrode contains glass, the adhesion force between the outer electrode and the multilayer body can be further increased due to interaction between a glass component contained in the outer electrode and a glass component contained in the insulating layer.

In the coil component according to still another preferred embodiment of the present disclosure, the outer electrode contains glass. With this embodiment, when the insulating layer contains glass and/or a composite material of glass and ferrite, the adhesion force between the outer electrode and the multilayer body can be further increased due to interaction between a glass component contained in the outer electrode and a glass component contained in the insulating layer.

In the coil component according to still another preferred embodiment of the present disclosure, the first magnetic layer and the second magnetic layer contain ferrite. With this embodiment, characteristics (such as an inductance value and DC superposed characteristics) of the coil component can be improved.

In the coil component according to still another preferred embodiment of the present disclosure, plural ones of the outer electrodes are present adjacent to each other on one surface of the multilayer body. With this embodiment, the distance between the outer electrodes adjacent to each other can be made relatively large in portions of the outer electrodes, and those portions contact the first magnetic layer and the second magnetic layer. It is hence possible to reduce a risk of the occurrence of a short circuit failure, and to enhance electrical reliability of the coil component.

In the coil component according to still another preferred embodiment of the present disclosure, the coil has lead-out portions, each of which extends to the surface of the insulating layer and is connected to a respective one of the outer electrodes. With this embodiment, the lead-out portion extend up to the surface of the insulating layer is connected to the relatively wide portion of the outer electrode. Therefore, the incidence of an exposure failure in the lead-out portion of the coil can be reduced.

In the coil component according to still another preferred embodiment of the present disclosure, the multilayer body further includes a first outermost insulating layer laminated under the first magnetic layer, and a second outermost insulating layer laminated on the second magnetic layer. In that case, the outer electrodes are each present over respective surfaces of the first outermost insulating layer, the first magnetic layer, the insulating layer, the second magnetic layer, and the second outermost insulating layer, and the first outermost insulating layer and the second outermost insulating layer contain glass and/or a composite material of glass and ferrite. With this embodiment, when the outer electrode contains glass, the adhesion force between the outer electrode and the multilayer body can be further increased due to interaction between a glass component contained in the outer electrode and a glass component contained in each of the first outermost insulating layer and the second outermost insulating layer.

In the coil component according to still another preferred embodiment of the present disclosure, widths of portions of at least one of the outer electrodes contacting the first outermost insulating layer and the second outermost insulating layer, are larger than the widths of the portions of the one outer electrode contacting the first magnetic layer and the second magnetic layer. With this embodiment, since the widths of the outer electrode in its portions contacting the first outermost insulating layer and the second outermost insulating layer are relatively large, the adhesion force between the outer electrode and each of the first outermost insulating layer and the second outermost insulating layer can be further increased.

In the coil component according to still another preferred embodiment of the present disclosure, a width of the insulating layer in a direction perpendicular to a lamination direction of the multilayer body is smaller than that of each of the first magnetic layer and the second magnetic layer in at least one of cross-sections that pass a center of the multilayer body and are perpendicular or parallel to the surface of the multilayer body where at least one of the outer electrodes is disposed. With this embodiment, a contact area between the outer electrode and the insulating layer can be increased. As a result, the adhesion force between the outer electrode and the multilayer body can be further increased.

In the coil component according to still another preferred embodiment of the present disclosure, $0 \leq L < R$ is satisfied such that, in a cross-section passing a center of the multilayer body and being perpendicular to a lamination direction of the multilayer body, R represents the radius of curvature of a corner formed by a first side of the multilayer body contacting any one of the outer electrodes and a second side of the multilayer body adjacent to the first side, and L represents a shortest distance from the second side to the one outer electrode along a direction parallel to the first side. With this embodiment, the contact area between the outer electrode and the multilayer body can be further increased. As a result, the adhesion force between the outer electrode and the multilayer body can be further increased.

In the coil component according to still another preferred embodiment of the present disclosure, a value of R is not less than about 0.01 mm, and a rate of R with respect to a length of the first side is not more than about 9%. With this embodiment, the contact area between the outer electrode and the multilayer body can be further increased. As a result, the adhesion force between the outer electrode and the multilayer body can be further increased.

Other features, elements, characteristics and advantages of the present disclosure will become more apparent from the following detailed description of preferred embodiments of the present disclosure with reference to the attached drawings.

DETAILED DESCRIPTION

Figure 1:
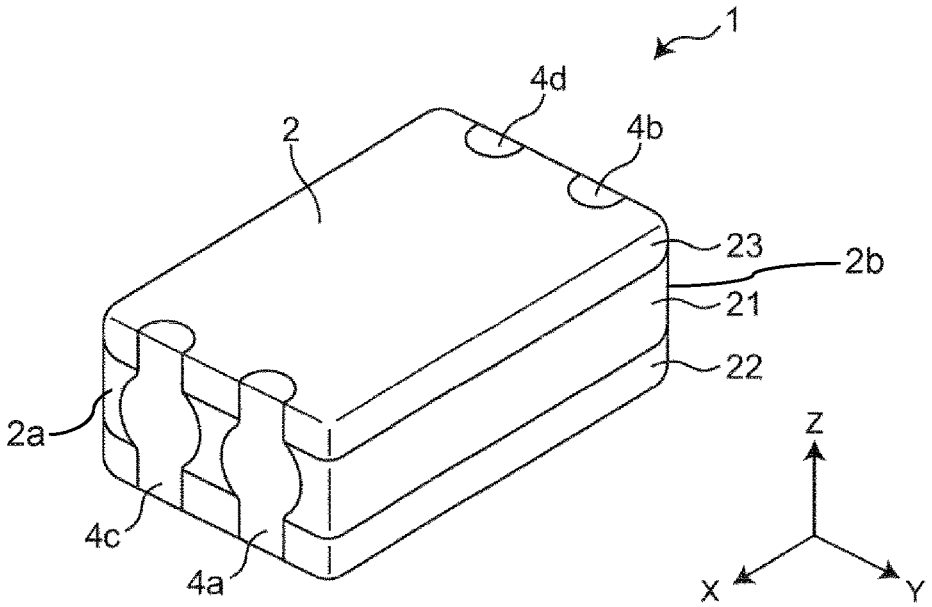
FIG. 1 is a perspective view of a coil component according to a first embodiment of the present disclosure.

The present disclosure will be described in detail below in connection with illustrated embodiments. It is to be noted that shapes, arrangements, etc. of coil components and constituent elements according to the embodiments of the present disclosure are not limited to examples described in the following embodiments and illustrated in the drawings.

First Embodiment

Figure 2A:
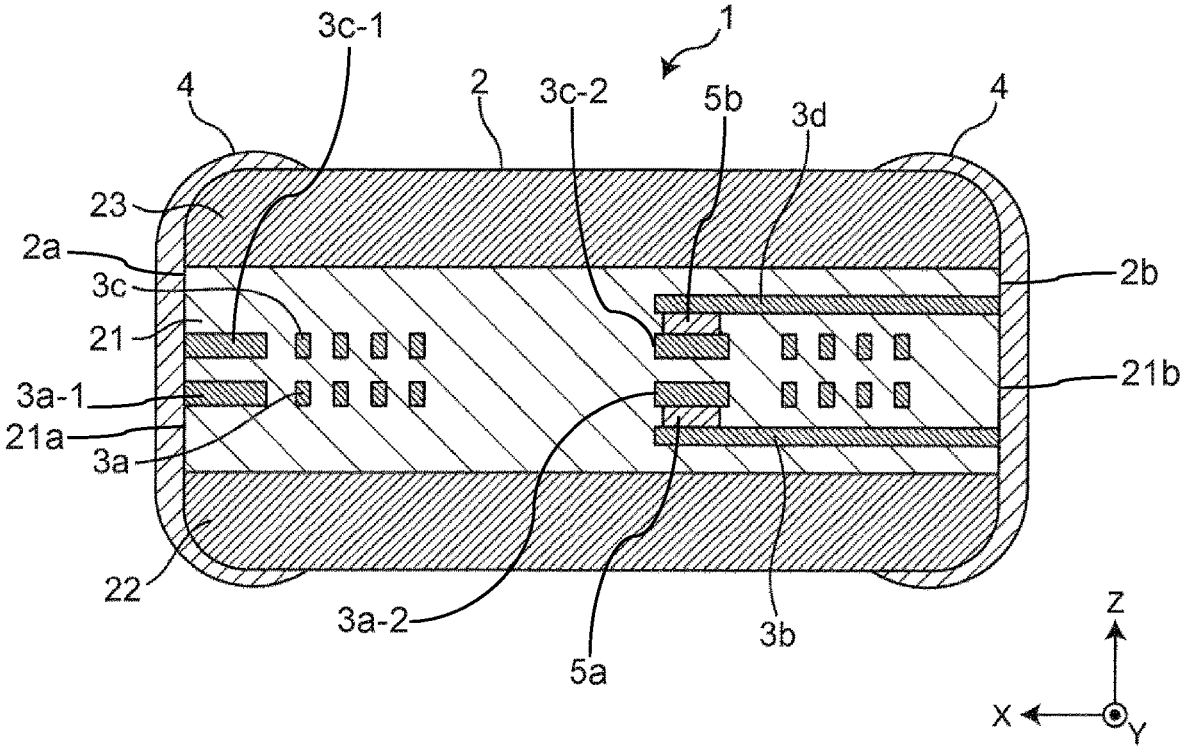
FIG. 2A is an XZ-sectional view of the coil component.
Figure 2B:
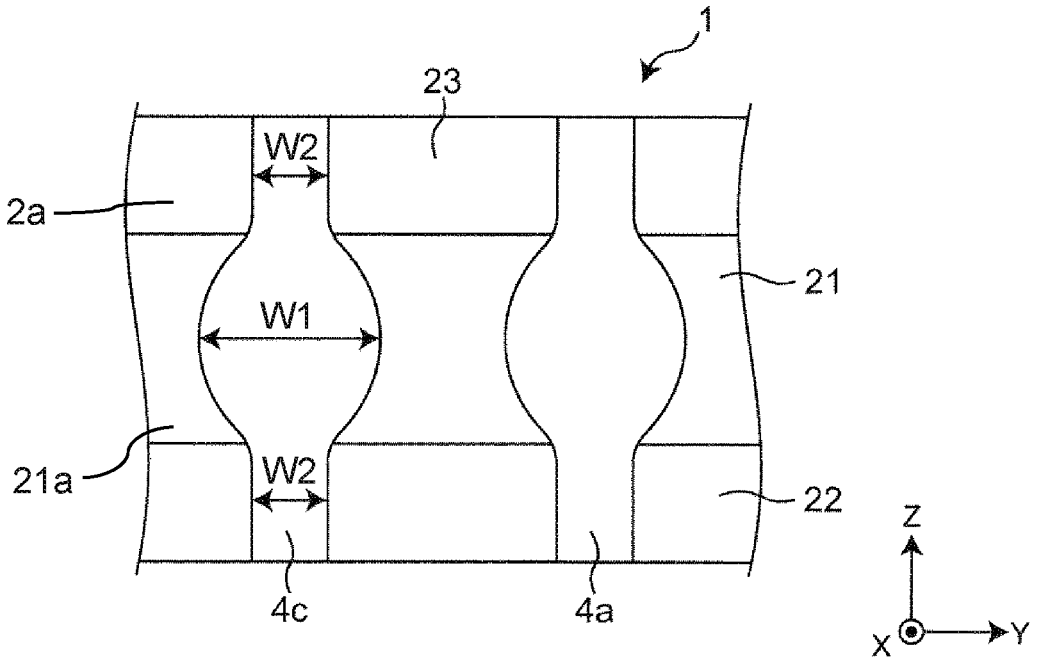
FIG. 2B is a partial end view of the coil component.
Figure 3:
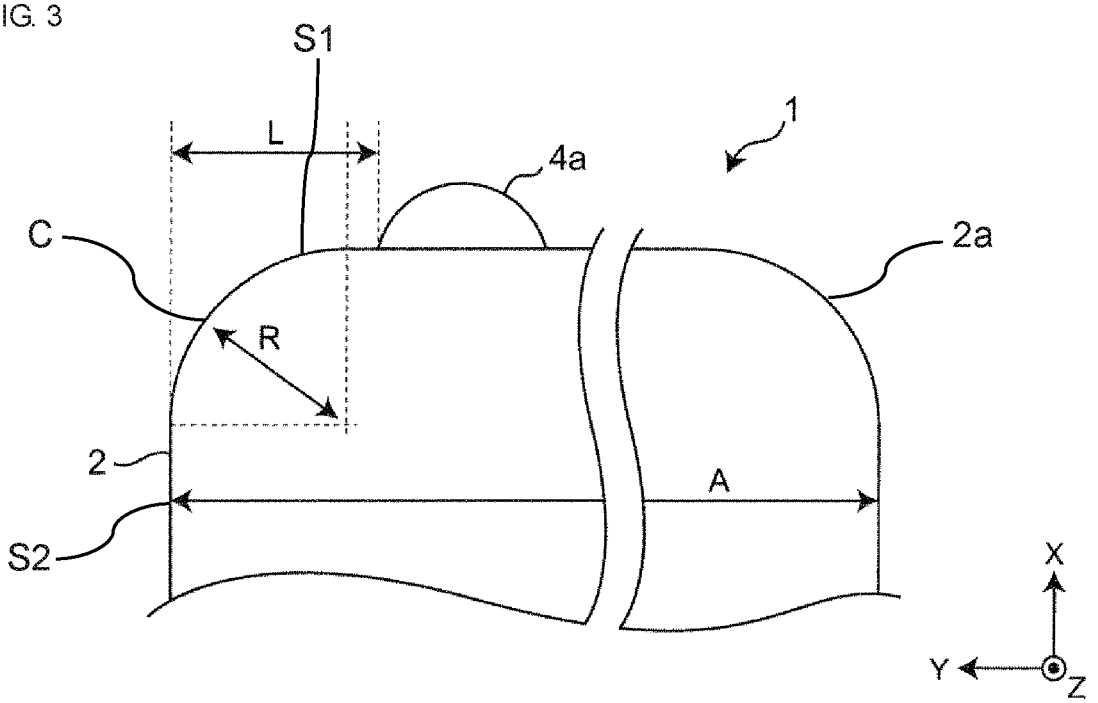
FIG. 3 is a partial sectional view of the coil component.
Figure 4:
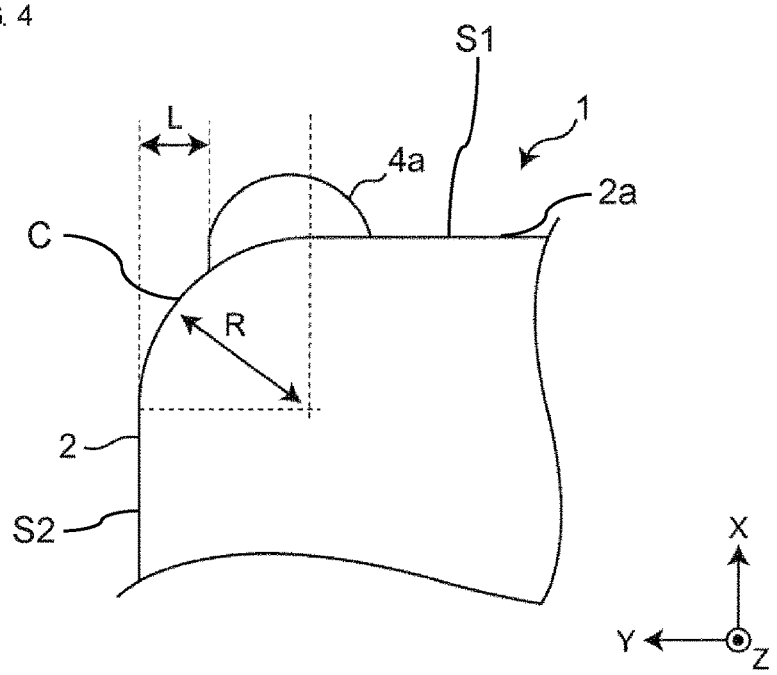
FIG. 4 is a partial sectional view of the coil component.

FIG. 1 is a perspective view of a coil component 1 according to a first embodiment of the present disclosure. FIG. 2A is an XZ-sectional view of the coil component. FIG. 2B is a partial end view of the coil component. FIG. 3 and FIG. 4 are each a partial sectional view of the coil component. As illustrated in FIGS. 1 to 4, the coil component 1 includes a multilayer body 2, coils (including a primary coil 3*a* and a secondary coil 3*c* illustrated in FIG. 2A) provided inside the multilayer body 2, and two or more outer electrodes (4*a* and 4*b*) disposed on surfaces (e.g., 2*a* and 2*b*) of the multilayer body 2. The coil component 1 may be, for example, a common mode choke coil, an inductor element, or an LC composite component constituted by a coil and a capacitor.

The multilayer body 2 includes a first magnetic layer 22, an insulating layer 21 laminated on the first magnetic layer 22, and a second magnetic layer 23 laminated on the insulating layer 21. In other words, the multilayer body 2 includes the insulating layer 21, and the first magnetic layer 22 and the second magnetic layer 23 sandwiching the insulating layer 21 therebetween in a vertical direction.

The insulating layer 21 is made of an insulating material, such as a resin material, a glass material, or a glass ceramic. Preferably, the insulating layer 21 contains glass and/or a composite material of glass and ferrite. The glass may be, for example, alkali borosilicate glass. The composite material of glass and ferrite may be, for example, a composite material of alkali borosilicate glass and Ni—Cu—Zn based ferrite. When the insulating layer 21 contains such a glass component, adhesion force between the outer electrode and the multilayer body is increased as described later.

The first magnetic layer 22 and the second magnetic layer 23 are made of an oxide magnetic material. Preferably, each of the first magnetic layer 22 and the second magnetic layer 23 contains ferrite. The ferrite may be, for example, Ni—Cu—Zn based ferrite. With each of the first magnetic layer 22 and the second magnetic layer 23 containing the magnetic material, characteristics (such as an inductance value and DC superposed characteristics) of the coil component 1 can be improved. The first magnetic layer 22 and the second magnetic layer 23 may have the same composition or different compositions.

The multilayer body 2 is formed in a substantially rectangular parallelepiped shape. Corners of the multilayer body 2 may be rounded. A lamination direction of the multilayer body 2 is defined as a Z-axis direction, a direction along a long side of the multilayer body 2 is defined as an X-axis direction, and a direction along a short side of the multilayer body 2 is defined as a Y-axis direction. An X-axis, a Y-axis, and a Z-axis are perpendicular to one another. In the drawings, an upper side is defined as an upward direction in the Z-axis direction, and a lower side is defined as a downward direction in the Z-axis direction.

The coil component 1 includes coils as inner conductors. The coil component 1 illustrated in FIG. 2A includes two coils, i.e., the primary coil 3*a* and the secondary coil 3*c*. It is to be noted that the coil component 1 according to the embodiment of the present disclosure is not limited to the configuration including two coils, and that the coil component may include only one coil or three or more coils.

The coils including the primary coil 3*a* and the secondary coil 3*c* are arranged inside the insulating layer 21 of the multilayer body 2. The primary coil 3*a* and the secondary coil 3*c* are successively positioned in the lamination direction of the multilayer body 2, and they constitute a common mode choke coil. The coils including the primary coil 3*a* and the secondary coil 3*c* are each made of a conductive material such as Ag, Ag—Pd, Cu, or Ni, for example. Each coil may further contain a metal oxide such as $Al_2O_3$.

The primary coil 3*a* and the secondary coil 3*c* have spiral patterns spirally wound in the same direction when viewed from above. Each of the coils including the primary coil 3*a* and the secondary coil 3*c* has, at both ends thereof, lead-out portions each of which extends up to the surface of the multilayer body 2 and is connected to any one of the outer electrodes. More specifically, one end of the primary coil 3*a* on the outer peripheral side of the spiral shape has one lead-out portion 3*a*-1 extending up to the surface 2*a* of the multilayer body 2, and the other end of the primary coil 3*a* at a center of the spiral shape has a pad portion 3*a*-2. The pad portion 3*a*-2 of the primary coil 3*a* is electrically connected to the other lead-out portion (denoted by a reference sign 3*b* in FIG. 2A) of the primary coil 3*a* through a via conductor 5*a* that is provided inside the insulating layer 21. The lead-out portion 3*b* is laid to extend up to the surface 2*b* of the multilayer body 2. Similarly, one end of the secondary coil 3*c* on the outer peripheral side of the spiral shape has one lead-out portion 3*c*-1 extending up to the surface 2*a* of the multilayer body 2, and the other end of the secondary coil 3*c* at a center of the spiral shape has a pad portion 3*c*-2. The pad portion 3*c*-2 of the secondary coil 3*c* is electrically connected to the other lead-out portion (denoted by a reference sign 3*d* in FIG. 2A) of the secondary coil 3*c* through a via conductor 5*b* that is provided inside the insulating layer 21. The lead-out portion 3*d* is laid to extend up to the surface 2*b* of the multilayer body 2.

The coil component 1 illustrated in FIG. 1 includes a first outer electrode 4*a*, a second outer electrode 4*b*, a third outer electrode 4*c*, and a fourth outer electrode 4*d*, each which can be referred to individually or collectively as an outer electrode 4. It is to be noted that the number of outer electrodes 4 may be changed depending on the number of inner conductors, and that the coil component may include only two (i.e., one pair of) outer electrodes 4, or three or more, for example, six or more (i.e., three or more pairs of) outer electrodes 4.

In the coil component 1 illustrated in FIG. 2A, the primary coil 3*a* has, at one end thereof, the lead-out portion 3*a*-1 extending up to the surface 2*a* of the multilayer body 2 and connected to, for example, the first outer electrode 4*a*, and has, at the other end thereof, the lead-out portion 3*b* extending up to the surface 2*b* of the multilayer body 2 and connected to, for example, the second outer electrode 4*b*. Similarly, the secondary coil 3*c* has, at one end thereof, the lead-out portion 3*c*-1 extending up to the surface 2*a* of the multilayer body 2 and connected to, for example, the third outer electrode 4*c*, and has, at the other end thereof, the lead-out portion 3*d* extending up to the surface 2*b* of the multilayer body 2 and connected to, for example, the fourth outer electrode 4*d*.

As discussed above, preferably, the coil 3*a* has, at the respective ends thereof, the lead-out portions 3*a*-1 and 3*b* which extend up to the respective surfaces 21*a* and 21*b* of the insulating layer 21. Lead-out portion 3*a*-1 is connected to any one of the outer electrodes 4*a* or 4*c*, and lead-out portion 3*b* is connected to any one of the outer electrodes 4*b* or 4*d*. Similarly, the coil 3*c* has, at the respective ends thereof, the lead-out portions 3*c*-1 and 3*d* which extend up to the respective surfaces 21*a* and 21*b* of the insulating layer 21. Lead-out portion 3*c*-1 is connected to any one of the outer electrodes 4*a* or 4*c*, and lead-out portion 3*d* is connected to any one of the outer electrodes 4*b* or 4*d*. A width W1 of a portion of each of the outer electrodes 4*a* through 4*d* contacting the insulating layer 21 is larger than a width W2 of the portions contacting each of the first magnetic layer 22 and the second magnetic layer 23. Therefore, the lead-out portions 3*a*-1, 3*c*-1, 3*b* and 3*d* of the coils 3*a* and 3*c* that extend up to the surfaces 21*a* and 21*b* of the insulating layer 21 as discussed above are connected to the relatively wide portions of the outer electrodes 4*a* through 4*d*. As a result, the incidence of exposure failures in the lead-out portions 3*a*-1, 3*c*-1, 3*b* and 3*d* of the coils 3*a* and 3*c* can be reduced.

The outer electrodes 4*a* through 4*d* are present over respective surfaces of the first magnetic layer 22, the insulating layer 21, and the second magnetic layer 23 as discussed herein. In the coil component 1 illustrated in FIG. 1, the first outer electrode 4*a* and the third outer electrode 4*c* are formed on one end surface 2*a* of the multilayer body 2, the one end surface being parallel to a YZ-plane. The second outer electrode 4*b* and the fourth outer electrode 4*d* are formed on the other end surface 2*b* of the multilayer body 2 opposing to the one end surface 2*a* where the first outer electrode 4*a* and the third outer electrode 4*c* are formed. The first to fourth outer electrodes 4*a* to 4*d* may be laid to extend in a substantially C-shape, as illustrated in FIG. 1, in the up-down direction of the multilayer body 2.

As discussed above, in at least one of the outer electrodes 4*a* through 4*d*, the width W1 of its portion contacting the insulating layer 21 is larger than the widths W2 of its portions contacting the first magnetic layer 22 and the second magnetic layer 23. In the coil component 1 illustrated in FIG. 1, the respective portion of each of the first outer electrode 4*a*, the second outer electrode 4*b*, the third outer electrode 4*c*, and the fourth outer electrode 4*d* contacting the insulating layer 21 has a larger width W1 than the width W2 of each of portions thereof contacting the first magnetic layer 22 and the second magnetic layer 23 (see FIG. 2B). By setting the width W1 of at least one outer electrode 4 to be partly wider as described above, the adhesion force between the outer electrode 4 and the multilayer body 2 can be made stronger than that in the coil components disclosed in Japanese Unexamined Patent Application Publication No. 2007-81228 and No. 2016-178140 in which the width of the outer electrode is uniform. As a result, the outer electrode 4 can be suppressed from peeling off from the multilayer body 2 when mechanical stress is applied to the coil component. In this specification, the "width" of the outer electrode 4 implies a width measured in a direction (Y-direction) that is perpendicular to the lamination direction of the multilayer body 2, and that is parallel to the surface 2*a* or 2*b* of the multilayer body 2 where the outer electrode 4 is disposed.

Each of the outer electrodes 4*a* through 4*d* is made of a conductive material such as Ag, Ag—Pd, Cu, or Ni, for example. Preferably, each of the outer electrodes 4*a* through 4*d* contains glass such as alkali borosilicate glass. When the outer electrode 4 contains glass and the insulating layer 21 contains glass and/or a composite material of glass and ferrite, the adhesion force between the outer electrode 4 and the multilayer body 2 can be further increased due to interaction between a glass component contained in the outer electrode 4 and a glass component contained in the insulating layer 21. The effect of increasing the adhesion force due to the interaction between the glass component contained in the outer electrode 4 and the glass component contained in the insulating layer 21 is made more significant with the above-described feature; namely the width W1 of the outer electrode 4 in its portion contacting the insulating layer 21 is larger than the width W2 of the outer electrode 4 in its portion contacting each of the first magnetic layer 22 and the second magnetic layer 23.

In the coil component 1, plural ones of the outer electrodes 4 may exist adjacent to each other on one surface of the multilayer body 2. In the coil component 1 illustrated in FIG. 1, the first outer electrode 4*a* and the third outer electrode 4*c* are present adjacent to each other on one end surface 2*a* of the multilayer body 2. The second outer electrode 4*b* and the fourth outer electrode 4*d* are present adjacent to each other on the other end surface 2*b* of the multilayer body 2 opposing to the one end surface where the first outer electrode 4*a* and the third outer electrode 4*c* are disposed. As described above, since the width of the outer electrode 4 in its portion contacting the insulating layer 21 is larger than that of the outer electrode 4 in its portion contacting each of the first magnetic layer 22 and the second magnetic layer 23, the adhesion force between the outer electrode 4 and the multilayer body 2 can be increased. On the other hand, since the width W2 of each of the portions of the outer electrode 4 contacting the first magnetic layer 22 and the second magnetic layer 23 is smaller than the width W1 of the portion contacting the insulating layer 21, the distance between the outer electrodes 4 adjacent to each other can be increased in the portions of the outer electrode 4 contacting the first magnetic layer 22 and the second magnetic layer 23. Generally, a magnetic material, such as ferrite, has a tendency to have a higher electrical conductivity than an insulating material such as glass. Accordingly, when the distance between the outer electrodes 4 adjacent to each other is relatively large in the portions of the outer electrodes 4 contacting the first magnetic layer 22 and the second magnetic layer 23, it is possible to reduce a risk of the occurrence of a short circuit failure, and to enhance electrical reliability of the coil component.

It is here assumed, as illustrated in FIGS. 3 and 4, that, in a cross-section (XY-section) passing a center of the multilayer body 2 and being perpendicular to the lamination direction of the multilayer body 2, R represents the radius of curvature of a corner C formed by a first side S1 of the multilayer body 2 that contacts any one (e.g., the first outer electrode 4*a*) of the outer electrodes 4, and a second side S2 thereof adjacent to the first side S. Also, L represents the shortest distance from the second side S2 to the relevant one outer electrode 4 along a direction parallel to the first side S1. On the above assumption, R and L preferably satisfy the following formula (see FIG. 4):

$$0 \leq L < R$$

When R and L satisfy the above formula, a contact area between the outer electrode 4 and the multilayer body 2 becomes larger than that in the case where R is smaller than L (see FIG. 3), and the adhesion force between the outer electrode 4 and the multilayer body 2 is further increased. Such an effect is more significant when the outer electrode 4 and the insulating layer 21 contain the glass components. Moreover, with increasing size reduction of the coil component 1, the size of the outer electrode 4 tends to reduce. In the case of providing the outer electrode 4 in a plural number, the size of the outer electrode 4 further reduces. By setting values of R and L to satisfy the above formula, the adhesion force between the outer electrode 4 and the multilayer body 2 can be increased even when the size of the outer electrode 4 is small.

The value of R is preferably not less than about 0.01 mm. A rate of R with respect to a length of the first side S1 of the multilayer body 2 in the XY-section is preferably not more than about 9%. It is here assumed that, as illustrated in FIG. 3, the length of the first side S1 implies the distance A between the second side S2 adjacent to the first side S1 and a third side S3 opposing to the second side. When the value of R falls within the above-mentioned range, the contact area between the outer electrode 4 and the multilayer body 2 can be further enlarged, and the adhesion force between the outer electrode 4 and the multilayer body 2 can be further increased.

The values of R and L can be measured with a measuring microscope or a digital microscope, for example, in a cross-section that is obtained by cutting the multilayer body 2 perpendicularly to the lamination direction at a position of ½ of the height of the multilayer body 2 in the lamination direction. The length of the first side S1in the XY-section can be measured with a micrometer.

A method of manufacturing the coil component 1 will be described below.

The coils 3*a* and 3*c* are formed on insulator sheets each containing glass such as alkali borosilicate glass, or a composite material of glass, such as alkali borosilicate glass, and ferrite, such as Ni—Cu—Zn based ferrite. A method of forming the coils 3*a* and 3*c* is not limited to particular one, and it may be plating or screen printing, for example. A conductive material used in forming the coils 3*a* and 3*c* may be Ag, Ag—Pd, Cu, or Ni, for example, and may further contain a metal oxide such as $Al_2O_3$.

Via holes are bored in the insulating sheets by an appropriate technique, such as laser processing, and via conductors are formed by filling the conductive material in the via holes such that, when the insulating sheets are laminated into a multilayer body 2, the multilayer body 2 functions as the coil component 1, such as a common mode choke coil, an inductance element, or an LC composite component, with the conductive materials in some layers being connected to those in other layers through the via conductors. The insulator sheets are laminated and sandwiched between the first magnetic layer and the second magnetic layer, each containing the magnetic material such as Ni—Cu—Zn based ferrite, from above and below. The multilayer body 2 thus obtained is subjected to pressure bonding with isostatic press, for example, and is cut into individual chip-like multilayer bodies each having a predetermined shape. The chip-like multilayer bodies are fired, and chips after the firing are subjected to barrel polishing, thereby removing burrs on surfaces of the multilayer bodies.

An outer electrode paste is coated over the surfaces of each of the multilayer bodies to form outer electrode patterns corresponding to two or more outer electrodes 4. The outer electrode paste is coated such that a portion of the outer electrode pattern, the portion being positioned on the insulating layer, has a larger width than each of portions thereof being positioned in the first magnetic layer and the second magnetic layer. The outer electrodes 4 are formed by baking the outer electrode paste that has been coated in the pattern forms as described above. Plating may be applied to the outer electrodes 4. Thus, the coil component 1 according to this embodiment can be obtained.

Second Embodiment

Figure 5A:
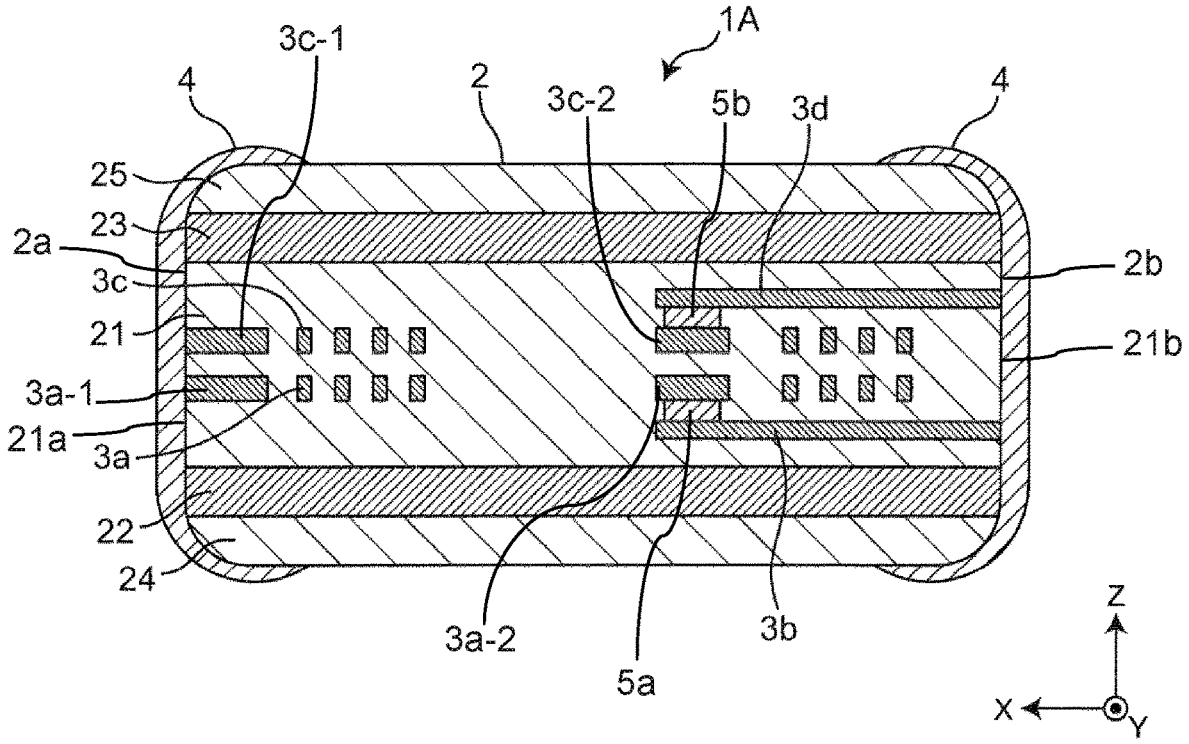
FIG. 5A is an XZ-sectional view of a coil component according to a second embodiment of the present disclosure.
Figure 5B:
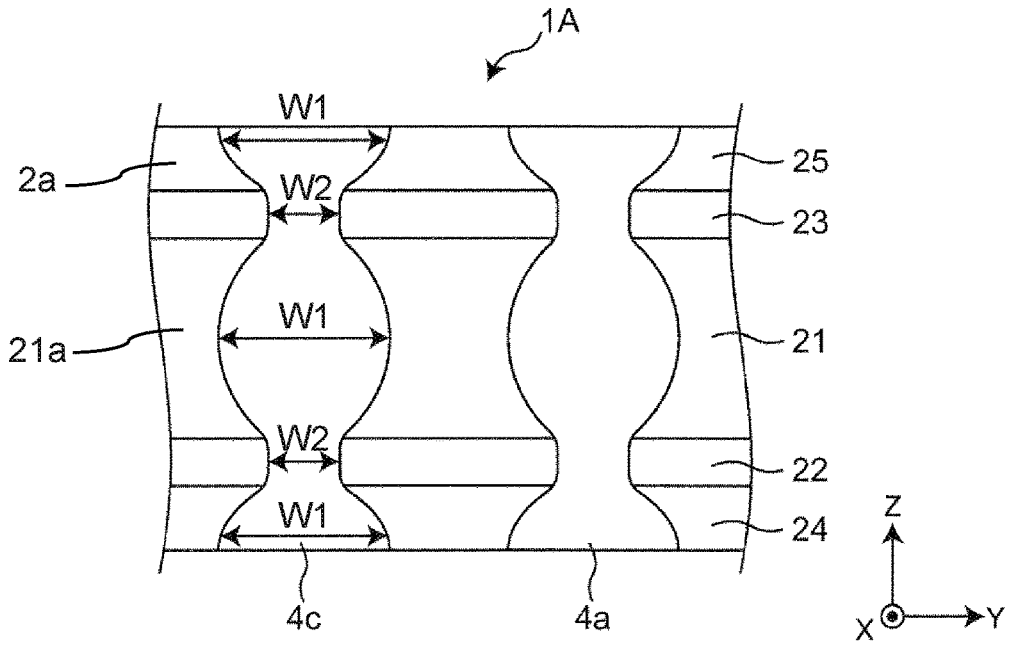
FIG. 5B is a partial end view of the coil component.

FIG. 5A is an XZ-sectional view of a coil component 1A according to a second embodiment of the present disclosure, and FIG. 5B is a partial end view of the coil component 1A. The second embodiment is different from the first embodiment in that the multilayer body 2 further includes a first outermost insulating layer 24 and a second outermost insulating layer 25. Only such a different point will be described below. It is to be noted that, in the second embodiment, the same reference signs as those in the first embodiment denote the same constituent elements in the first embodiment, and that description of those constituent elements is omitted.

In the coil component 1A according to the second embodiment, as illustrated in FIGS. 5A and 5B, the multilayer body 2 may further include the first outermost insulating layer 24 laminated under the first magnetic layer 22, and the second outermost insulating layer 25 laminated on the second magnetic layer 23. In that case, the outer electrodes 4 are each present over respective surfaces of the first outermost insulating layer 24, the first magnetic layer 22, the insulating layer 21, the second magnetic layer 23, and the second outermost insulating layer 25 as discussed herein. Preferably, the first outermost insulating layer 24 and the second outermost insulating layer 25 contain glass and/or a composite material of glass and ferrite. When the outer electrode 4 contains glass and each of the first outermost insulating layer 24 and the second outermost insulating layer 25 contains glass and/or the composite material of glass and ferrite, the adhesion force between the outer electrode 4 and the multilayer body 1A can be further increased due to interaction between a glass component contained in the outer electrode 4 and a glass component contained in each of the first outermost insulating layer 24 and the second outermost insulating layer 25.

Preferably, widths W1 of at least one of the outer electrodes 4 in its portions contacting the first outermost insulating layer 24 and the second outermost insulating layer 25 are larger than the widths W2 of the one outer electrode 4 in its portions contacting the first magnetic layer 22 and the second magnetic layer 23. Since the widths of the one outer electrode in its portions contacting the first outermost insulating layer 24 and the second outermost insulating layer 25 are relatively large, the adhesion force between the outer electrode and each of the first outermost insulating layer 24 and the second outermost insulating layer 25 can be further increased, and the effect of suppressing the outer electrode from peeling off from the multilayer body 2A can be made more significant.

The glass and/or the composite material of glass and ferrite possibly contained in the first outermost insulating layer 24 and the second outermost insulating layer 25 may be similar to the glass and/or the composite material possibly contained in the insulating layer 21. The first outermost insulating layer 24 and the second outermost insulating layer 25 may have the same composition as the insulating layer 21, or a different composition from that of the insulating layer 21. The first outermost insulating layer 24 and the second outermost insulating layer 25 may have the same composition or different compositions.

Third Embodiment

Figure 6:
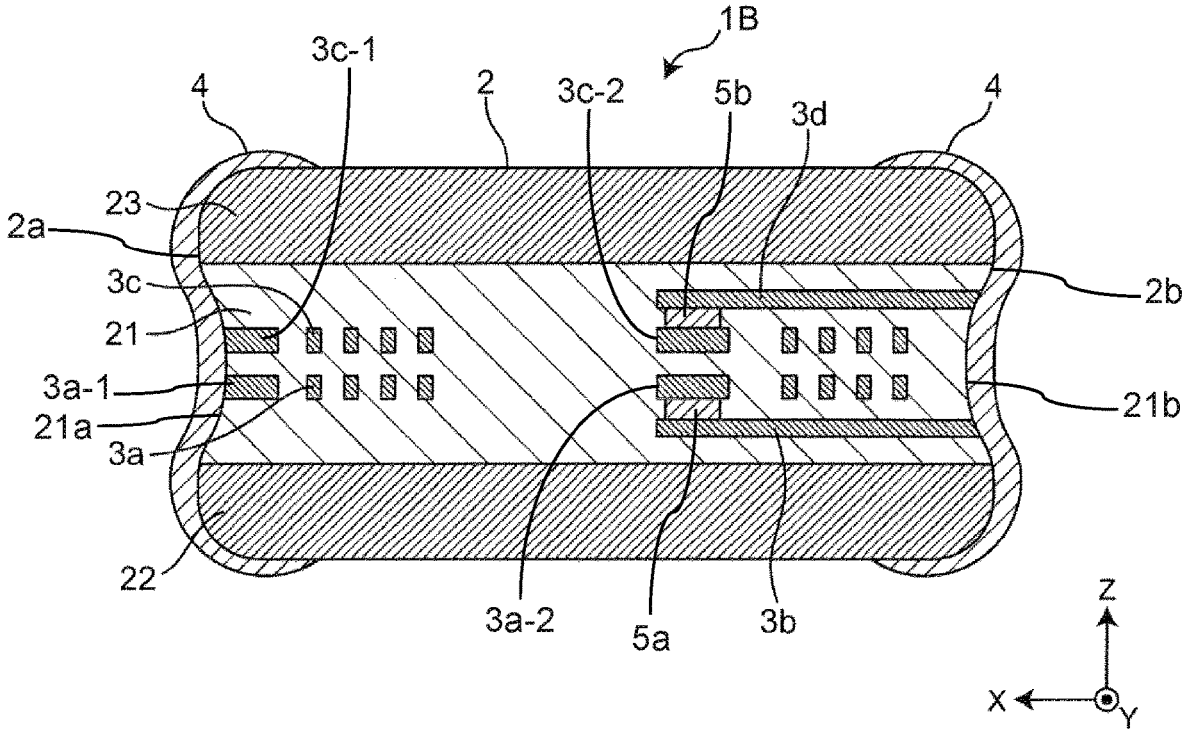
FIG. 6 is an XZ-sectional view of a coil component according to a third embodiment of the present disclosure.

FIG. 6 is an XZ-sectional view of a coil component 1B according to a third embodiment of the present disclosure. The third embodiment is different from the first embodiment in shape of the multilayer body 2. Only such a different point will be described below. It is to be noted that, in the third embodiment, the same reference signs as those in the first embodiment denote the same constituent elements in the first embodiment, and that description of those constituent elements is omitted.

In the coil component 1B according to the third embodiment, as illustrated in FIG. 6 by way of example, a width of the insulating layer 21 in the direction perpendicular to the lamination direction of the multilayer body 2 is preferably smaller than that of each of the first magnetic layer 22 and the second magnetic layer 23 in both of cross-sections (XZ-section and YZ-section) or either one thereof passing the center of the multilayer body 2 and being perpendicular and/or parallel to the surface of the multilayer body 2 where at least one of the outer electrodes is disposed. More specifically, in the coil component 1B illustrated in FIG. 6, the width of the insulating layer 21 in the direction (X-direction) perpendicular to the lamination direction of the multilayer body 2 is smaller than that of each of the first magnetic layer 22 and the second magnetic layer 23 in the XZ-section of the multilayer body. On condition of the outer electrodes 4 having the same width, such as width W1 discussed above, a contact area between the outer electrode 4 and the insulating layer 21 in the coil component 1B according to the third embodiment is larger than the contact area between the outer electrodes 4 and the insulating layers 21 in the coil components 1 and 1A according to the first and second embodiments. As a result, the adhesion force between the outer electrode 4 and the multilayer body 2 can be further increased.

The shape of the multilayer body 2 according to the third embodiment can be formed by appropriately adjusting a processing time, a diameter of barrel media, a barrel rotation speed, etc. when barrel polishing is performed on the multilayer body 2. While, in the coil component 1B illustrated in FIG. 6, the multilayer body 2B is constituted by three layers, i.e., the insulating layer 21, the first magnetic layer 22, and the second magnetic layer 23, the present disclosure is not limited to that case. For instance, the multilayer body 2 may be constituted by five layers, i.e., the first outermost insulating layer 24, the first magnetic layer 22, the insulating layer 21, the second magnetic layer 23, and the second outermost insulating layer 25, and the width of the insulating layer 21 in the direction perpendicular to the lamination direction of the multilayer body 2 may be smaller than that of each of the first magnetic layer 22 and the second magnetic layer 23. In this specification, the "width" of each of the insulating layer 21, the first magnetic layer 22, and the second magnetic layer 23 implies a minimum width of the relevant layer.

Fourth Embodiment

Figure 7:
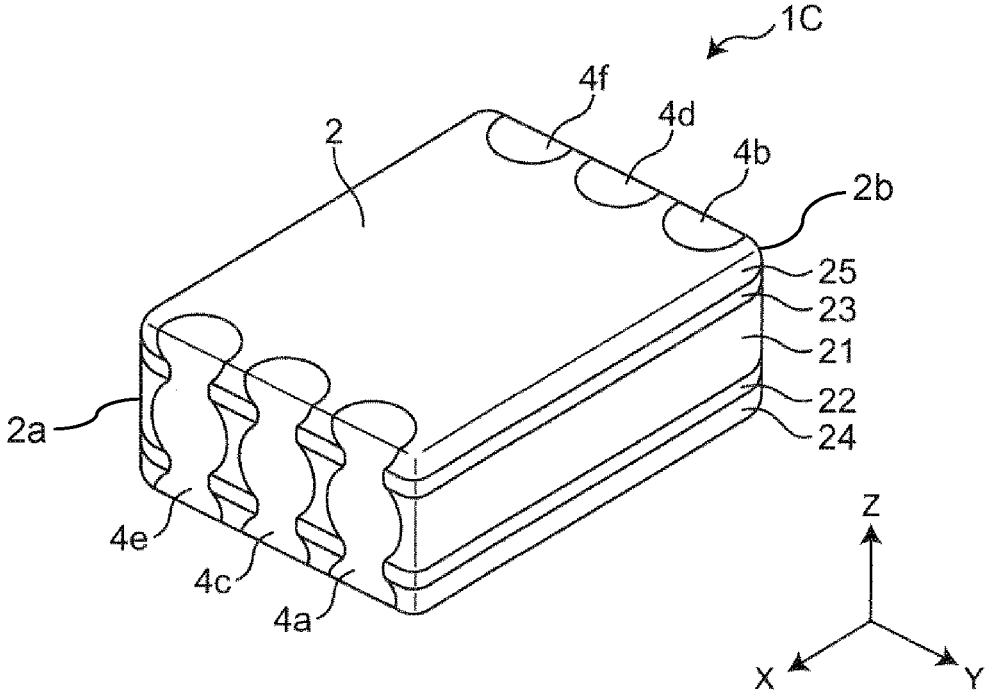
FIG. 7 is a perspective view of a coil component according to a fourth embodiment of the present disclosure.

FIG. 7 is a perspective view of a coil component IC according to a fourth embodiment of the present disclosure. The fourth embodiment is different from the first embodiment in the number of outer electrodes 4 and in including the first outermost insulating layer and the second outermost insulating layer as well. Only those different points will be described below. It is to be noted that, in the fourth embodiment, the same reference signs as those in the first to third embodiments denote the same constituent elements in the first to third embodiments, and that description of those constituent elements is omitted.

As illustrated in FIG. 7, the coil component IC according to the fourth embodiment includes a first outer electrode 4*a*, a second outer electrode 4*b*, a third outer electrode 4*c*, a fourth outer electrode 4*d*, a fifth outer electrode 4*e*, and a sixth outer electrode 4*f*. Those outer electrodes 4 are each present over the respective surfaces of the first outermost insulating layer 24, the first magnetic layer 22, the insulating layer 21, the second magnetic layer 23, and the second outermost insulating layer 25. In the coil component IC illustrated in FIG. 7, the first outer electrode 4*a*, the third outer electrode 4*c*, and the fifth outer electrode 4*e* are formed on one end surface 2*a* of the multilayer body 2, the one end surface 2*a* being parallel to the YZ-plane. The second outer electrode 4*b*, the fourth outer electrode 4*d*, and the sixth outer electrode 4*f* are formed on the other end surface 2*b* of the multilayer body 2 opposing to the one end surface 2*a* where the first outer electrode 4*a*, the third outer electrode 4*c*, and the fifth outer electrode 4*e* are formed. The first to sixth outer electrodes 4*a* to 4*f* may be laid to extend in a substantially C-shape, as illustrated in FIG. 7, in the up-down direction of the multilayer body 2.

On condition of the coil components having the same overall sizes, there is a tendency that, in the coil component IC according to the fourth embodiment and including the six outer electrodes, the width of each outer electrode 4 is smaller than that in the coil component 1 according to the first embodiment and including the four outer electrodes 4. In the coil components according to the embodiments of the present disclosure, however, the adhesion force between the outer electrode 4 and the multilayer body 2 can be increased, and the outer electrode 4 can be prevented from peeling off from the multilayer body. Accordingly, the coil component providing the increased adhesion force between the outer electrode 4 and the multilayer body 2 and having high reliability can be obtained even when the size (width) of the outer electrode 4 is small.

Because the adhesion force between the outer electrode 4 and the multilayer body 2 is increased and high reliability is ensured, the coil components according to the preferred embodiments of the present disclosure can be applied to a variety of electronic devices, such as personal computers, DVD players, digital cameras, TV's, cellular phones, and car electronics.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:
- a multilayer body including a first magnetic layer, an insulating layer laminated on the first magnetic layer, and a second magnetic layer laminated on the insulating layer;
- at least one coil provided inside the multilayer body; and
- outer electrodes disposed on at least one surface of the multilayer body,
- the coil has lead-out portions, each of which extends to the surface of the multilayer body and is connected to a respective one of the outer electrodes,
- the outer electrodes are each present over respective surfaces of the first magnetic layer, the insulating layer, and the second magnetic layer, and
- a width of a portion of at least one of the outer electrodes contacting the insulating layer is larger than a width of portions of the at least one of the outer electrodes contacting the first magnetic layer and the second magnetic layer, wherein
- the multilayer body further includes a first outermost insulating layer laminated under the first magnetic layer, and a second outermost insulating layer laminated on the second magnetic layer,
- the outer electrodes are also each present over respective surfaces of the first outermost insulating layer and the second outermost insulating layer, and
- widths of additional portions of the at least one of the outer electrodes contacting the first outermost insulating layer and the second outermost insulating layer are larger than the widths of the portions of the at least one of the outer electrodes contacting the first magnetic layer and the second magnetic layer.

2. The coil component according to claim 1, wherein plural ones of the outer electrodes are present adjacent to each other on the surface of the multilayer body.

3. The coil component according to claim 1, wherein the lead-out portions extend to the surface of the insulating layer.

4. The coil component according to claim 1, wherein a width of the insulating layer in a direction perpendicular to a lamination direction of the multilayer body is smaller than a width of each of the first magnetic layer and the second magnetic layer in at least one of: a first cross-section that passes a center of the multilayer body and is perpendicular to the surface of the multilayer body where at least one of the outer electrodes is disposed; and a second cross-section that passes the center of the multilayer body and is parallel to the surface of the multilayer body where the at least one of the outer electrodes is disposed.

5. The coil component according to claim 1, wherein the insulating layer contains at least one of:
- glass; and
- a composite material of glass and ferrite.

6. The coil component according to claim 5, wherein at least one of the outer electrodes contains glass.

7. The coil component according to claim 5, wherein the first magnetic layer and the second magnetic layer contain ferrite.

8. The coil component according to claim 5, wherein plural ones of the outer electrodes are present adjacent to each other on the surface of the multilayer body.

9. The coil component according to claim 5, wherein the lead-out portions extend to the surface of the insulating layer.

10. The coil component according to claim 5, wherein a width of the insulating layer in a direction perpendicular to a lamination direction of the multilayer body is smaller than a width of each of the first magnetic layer and the second magnetic layer in at least one of: a first cross-section that passes a center of the multilayer body and is perpendicular to the surface of the multilayer body where at least one of the outer electrodes is disposed; and a second cross-section that passes the center of the multilayer body and is parallel to the surface of the multilayer body where the at least one of the outer electrodes is disposed.

11. The coil component according to claim 5, wherein $0 \leq L < R$ is satisfied such that, in a cross-section that passes a center of the multilayer body and is perpendicular to a lamination direction of the multilayer body:

R represents a radius of curvature of a corner formed by a first side of the multilayer body contacting one of the outer electrodes, and a second side of the multilayer body adjacent to the first side, and L represents a shortest distance from the second side to the one of the outer electrodes along a direction parallel to the first side.

12. The coil component according to claim 1, wherein at least one of the outer electrodes contains glass.

13. The coil component according to claim 12, wherein the first outermost insulating layer and the second outermost insulating layer contain at least one of:

glass; and a composite material of glass and ferrite.

14. The coil component according to claim 12, wherein the first magnetic layer and the second magnetic layer contain ferrite.

15. The coil component according to claim 12, wherein plural ones of the outer electrodes are present adjacent to each other on the surface of the multilayer body.

16. The coil component according to claim 1, wherein the first magnetic layer and the second magnetic layer contain ferrite.

17. The coil component according to claim 16, wherein plural ones of the outer electrodes are present adjacent to each other on the surface of the multilayer body.

18. The coil component according to claim 1, wherein $0 \leq L < R$ is satisfied such that, in a cross-section that passes a center of the multilayer body and is perpendicular to a lamination direction of the multilayer body:

R represents a radius of curvature of a corner formed by a first side of the multilayer body contacting one of the outer electrodes, and a second side of the multilayer body adjacent to the first side, and L represents a shortest distance from the second side to the one of the outer electrodes along a direction parallel to the first side.

19. The coil component according to claim 18, wherein a value of R is not less than about 0.01 mm, and a rate of R with respect to a length of the first side is not more than about 9%.

* * * * *